US005636665A

United States Patent [19]

Lie

[11] Patent Number: 5,636,665

[45] Date of Patent: Jun. 10, 1997

[54] METHOD AND APPARATUS FOR FILLING AND EMPTYING OF TANK VEHICLES

[76] Inventor: Svien O. Lie, Smestuveien 21, N-1480 Slattum, Norway

[21] Appl. No.: 325,213

[22] PCT Filed: Apr. 21, 1993

[86] PCT No.: PCT/NO93/00064

§ 371 Date: Jan. 23, 1995

§ 102(e) Date: Jan. 23, 1995

[87] PCT Pub. No.: WO93/21051

PCT Pub. Date: Oct. 28, 1993

[30] Foreign Application Priority Data

Apr. 21, 1992 [NO] Norway ..... 921527

[51] Int. Cl.[6] ..... B65B 1/04; B65B 3/00

[52] U.S. Cl. ..... 141/1; 141/35; 105/358; 137/256

[58] Field of Search ..... 141/35, 237, 59, 141/374, 1; 105/358, 360; 137/256, 571, 572, 347, 265

[56] References Cited

U.S. PATENT DOCUMENTS

| | | | |
|---|---|---|---|
| 3,906,995 | 9/1975 | Schmidt | 141/35 |
| 4,002,192 | 1/1977 | Mowatt-Larssen | 141/35 |
| 4,079,760 | 3/1978 | Hurst | 141/35 |
| 4,266,580 | 5/1981 | Dixon | 141/35 |
| 4,304,271 | 12/1981 | Mowatt-Larssen | 141/35 |
| 4,711,274 | 12/1987 | Mowatt-Larssen | 141/35 |

FOREIGN PATENT DOCUMENTS

| | | |
|---|---|---|
| 119114 | 11/1970 | Denmark . |
| 2245594 | 9/1972 | Germany . |
| 2059892 | 4/1981 | United Kingdom . |

*Primary Examiner*—Henry J. Recla
*Assistant Examiner*—Steven O. Douglas
*Attorney, Agent, or Firm*—Browdy and Neimark

[57] ABSTRACT

A method and apparatus for collectively filling and emptying fluid in a plurality of tanks, particularly in a railway train. The apparatus enables filling and emptying via a hook-up at the filling terminal or discharge terminal.

10 Claims, 1 Drawing Sheet

METHOD AND APPARATUS FOR FILLING AND EMPTYING OF TANK VEHICLES

FIELD OF THE INVENTION

The invention relates to a method and apparatus for collectively filling and emptying fluid in a plurality of tanks, particularly In a railway train. The apparatus enables filling and emptying by means of a simple hook-up at the filling terminal or discharge terminal.

DESCRIPTION OF THE PRIOR ART

Railway transport by tank cars is hampered by long periods at the terminal for filling or discharging. This is because, until now, it was necessary for each tank to be connected Individually for filling and emptying. Today's systems also involve considerable shifting of Individual cars to and from the filling and discharge area. To make emptying and filling stations which are capable of servicing a plurality of cars, larger installations must be built with safeguards against leakage over a greater area.

Hitherto there has been developed a large-scale American system (TankTrain) which, by interconnection of a plurality of tank cars, pumps the fluid from car to car through a central overlying pipeline. This involves pressurization of the cars, which requires the use of specially constructed tanks. Also, the system is such that the train may be filled and emptied from one end only.

U.S. Pat. No. 3,722,556 and French patents no. 1005385 and no. 2125657 describe various methods for filling and emptying the cars. Danish patent no. 119114 and German laid-open patent application no. 2245594 describe tank cars where the tanks are connected to a common pipeline for filling and emptying. The Danish patent has a common pipeline positioned under the tanks, and each tank is equipped with a ventilation valve. The ventilation is conducted out into the surrounding atmosphere, such that any gases emitted from the fluid can pollute the environment. With this apparatus, as well as the one described in the German laid-open publication, each tank must be filled to the top ("topped off") individually, resulting in a slower and riskier filling process.

SUMMARY OF THE INVENTION

In contrast to the technique described in the Danish patent, according to the present application all of the tanks In the entire train or in a group of cars are connected to the adjacent tanks by a pipeline running between the tops of the tanks, intended for ventilating and topping off the tanks. A very simple filling and emptying procedure is thereby attained whereby, above all, large pressure differences among the tanks are avoided, and the tanks are topped off in parallel.

By using a central underlying filling and discharge line as a main line, together with an overlying return pipeline, the main filling can be done by filling up all the connected tanks in parallel as communicating vessels. For topping off the tanks, the overflow pipe is used.

The method according to the invention for collectively filling a plurality of tanks in, e.g, a railway train or a group of these tanks, where fluid under pressure is supplied to the common, permanently mounted filling and discharge line, where all the valves into the tanks are open, and likewise all safety valves are also open, and where the pumping continues until all the tanks are filled up to nearly full level, e.g., 80–95%, is characterized in that all valves between the pipeline and the tanks are closed with the exception of the valve to the car situated furthest away in relation to the supply end, that the pump pressure in the line is reduced and liquid is pumped into the car situated furthest away relative to the supply end until the remaining volume thereof is filled and fluid is conducted over the pipeline to the tank situated closest thereto, etc., until the entire row of tanks is topped off, whereafter all the valves are closed.

The method according to the invention in an alternative embodiment form for collectively filling a plurality of tanks in, e.g., a railway train or a group of these tanks, where fluid under pressure is supplied to the common, permanently mounted filling and discharge line, where all the valves into the tanks are open, and likewise all safety valves are also open, and where the pumping continues until all the tanks are filled up to full level, is characterized in that the first tank closest to the supply end is filled up first, due to lowest pressure drop in the filling end discharge line between the supply end and the first valve, then the next tanks are filled in sequence both via the valves and via the overflow pipes until all the tanks have been filled up and fluid enters the overflow pipe in the tank situated furthest away from the supply end, whereafter all the valves are closed.

The apparatus according to the present invention for collectively filling and emptying a plurality of tanks in a tank car train, particularly a railway train, comprising a common, continuous filling and discharge line permanently mounted along the row of cars, positioned under the tanks and connected to each individual tank by respective valves, is characterized in that all the tanks in the train or in a group of cars are connected to the adjacent tanks by a pipeline at the top of the tank, adapted for ventilating and topping off the tanks, and that the pipelines may be shut off for transport with valves placed on each tank.

The apparatus is further characterized by an alternative design where the permanently mounted filling and discharge line is placed inside the tanks for maximal protection in case of accidents, whereby the line is provided with branch pipes to the lowest level, and the branch pipes are each provided with respective shut-off valves.

When "fluid" is mentioned in the description and the subsequent claims, the term is meant to include liquid and gas, and other fluid states such as, e.g., silts/slurries. Although the invention is explained in terms of emptying and filling with a fluid, it is not limited to this, but may also be used for, e.g., gases and slurries.

BRIEF DESCRIPTION OF THE DRAWING FIGURES

The invention will be explained further in the following with the aid of the drawings, where:

DESCRIPTION OF THE PREFERRED EMBODIMENT

Figure 1:
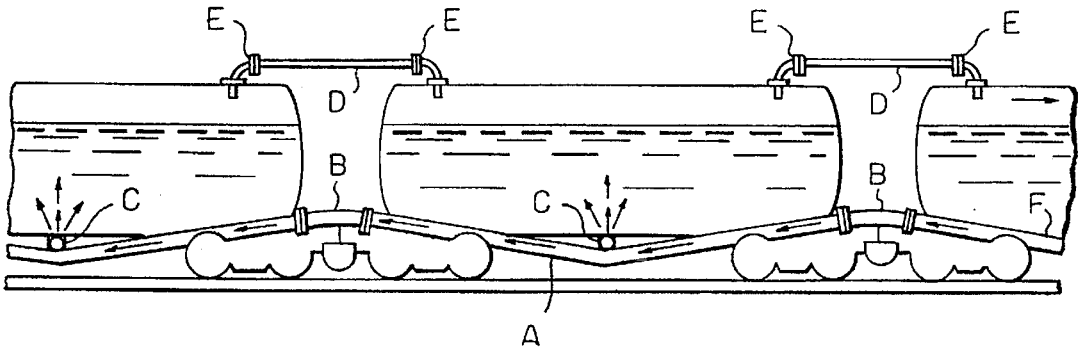
FIG. 1 shows the filling of a tank car in the first phase, i.e., until the car is about 80–95% full.
Figure 2:
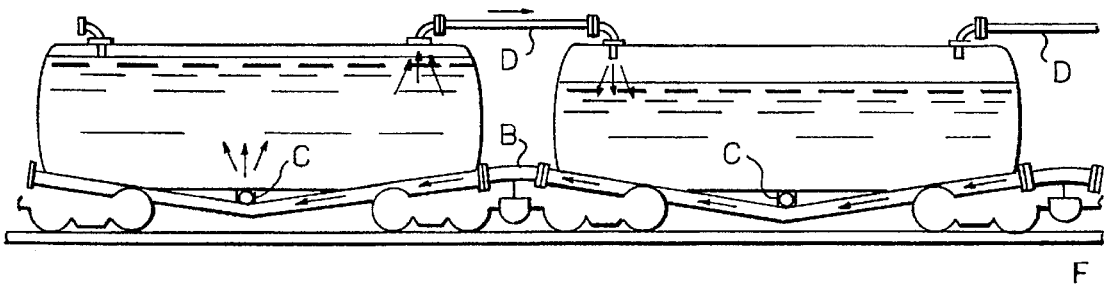
FIG. 2 shows the filling in the second phase (topping off).

The system is illustrated in FIG. 1 and FIG. 2, showing filling of tank cars in two phases. A Indicates the placement of the bottom pipeline (about 8" steel pipe) with a low break below the center of each car. B may be, e.g., a reinforced flexible rubber tube of the same dimension as A. This is laid on a transition bridge or suspended from the top C by guy wires. C is the valve connection between bottom line A and the tank. This has the same dimension as the return pipe D (about 4"), which is placed on the top between the cars. The valve at C and the valve at E may be closed prior to transport and thereby safeguard the car in case of overturning or collision. F is the filling and discharge connection for the entire length of the train, optionally placed at one of the ends of the train.

When a plurality of cars are to be filled using the method of the invention, the fluid is supplied to the permanently mounted filling and discharge line A. All valves C from line A and into the tanks are open. Similarly, all the safety valves E on the top of the tanks are open. The pumping through line A continues until all the cars in the row of tanks are filled up to almost full level, e.g., 80–95%. Then all the valves C are closed between line A and the tanks, with the exception of the valve C that is situated furthest away from the supply end F. Thereafter, the pump pressure in line A is lowered, and fluid is pumped into the most remotely situated car in relation to supply end F.

This pumping continues until the remaining volume in the most remotely situated tank has been filled, i.e., from 80–95% to the maximum. When this tank is full, additionally supplied fluid is conducted via pipe D over to the next tank closest thereto. When this tank is full, fluid will be conducted further via D to the tank adjacent to this one, until the entire row of tanks has been filled. Then all valves C between line A and the tanks are closed, and the tank cars are made ready for transport.

In an alternative method for filling the tanks, all the valves C and the safety valves E between the tanks are open, and fluid is supplied under pressure through line A until all the tanks are filled up to full level. In this method the tank closest to the supply end F will be filled up first due to pressure drop in line A. Then the next tanks are filled in sequence both via valves C and via the overflow pipes D on the top of the tanks. This continues until all the tanks are full, and fluid enters pipe D for the tank situated furthest away from supply end F. Then all valves C may be closed, and the tank cars may be readied for transport.

Figure 3:
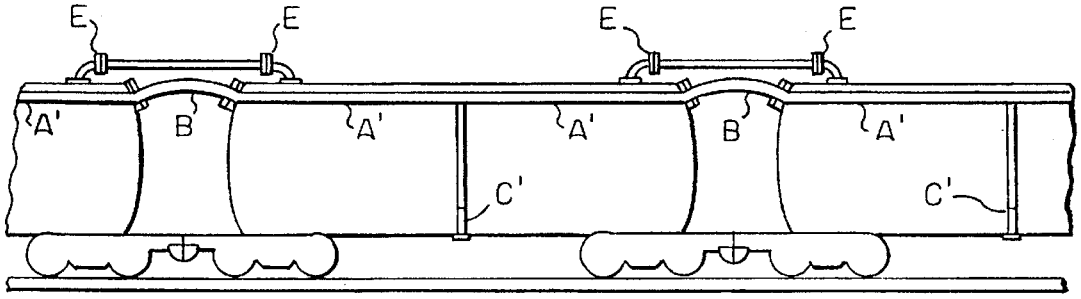
FIG. 3 shows an embodiment with an alternative placement of the filling/discharge line inside the tanks.

FIG. 3 shows an alternative embodiment where the main filling line A' is built into the tanks as an extra safety precaution for transport. From main line A' a vertical pipe runs down to the bottom of each tank, and this pipe is terminated with a valve C'.

After all the tanks are full, main line A' is emptied for safety reasons, and valves E on return pipe D are then closed. By this means each individual car is closed off and may be transported in accordance with the RID regulations (International convention on transport of dangerous goods by railway). These regulations require that the transport takes place without there being any fluid In the pipeline connections between the tank cars.

To empty the tanks, a discharge pump (not shown) is connected to main line A and all cocks C and E on main line A and return pipe D are opened. When a tank is empty, the bottom cock C is closed either manually or with a float valve. This makes it impossible for air to be sucked from this tank, and fluid must be drawn from some of the other tanks that have not been emptied. The shut-off procedure is repeated until all the tanks are empty.

Main line A may consist, e.g., of an approx. 8" steel pipe. The transition between the cars B may be made, e.g., with a flexible 8" reinforced rubber tube B suspended or laid on a transition bridge between the cars. The main line is connected to the tanks by a thinner pipe of about 4" which may be shut off by a valve C.

Return pipe D is laid between the cars above the maximum fluid level in the uppermost part of the tanks. For the return pipes there may be used flexible tubes of about 4", which during transport may be shut off at the tanks by means of cocks E.

To limit the spill of contaminating gases into the surroundings there may be connected at the end of the tank car where the filling and discharge pump is situated, e.g., an external return pipe which conducts the evaporation gases to a condenser.

I claim:

1. A method for collectively filling a plurality of tanks in a group or row of railway tanks, where fluid under pressure is supplied to a permanently mounted, common filling and discharge line (A), where all of a plurality of valves (C) communicating between the line and the tanks are open, and safety-valves (E) disposed in pipes (D) connected in fluid communication between adjacent tanks in said group or row are all also open, and where pumping continues until all the tanks are filled up to a nearly full level, wherein all the valves (C) between the line (A) and the tanks are closed with the exception of a furthest one of the valves (C) to one of the tanks situated furthest away in relation to a supply end (F), the pump pressure in the line (A) is reduced and liquid is pumped into the one of the tanks situated furthest away in relation to the supply end (F) until the remaining volume thereof is filled up and fluid is conducted over the pipe (D) to one of the tanks situated adjacent thereto, until the entire group or row of tanks is topped off, whereafter all the valves (C) are closed.

2. A method for collectively filling a plurality of tanks in a group of railway tanks, where fluid under pressure is supplied to a permanently mounted, common filling and discharge line (A), where all of a plurality of valves (C) communicating between the line and the tanks are open, and safety-valves (E) disposed in pipes (D) connected in fluid communication between adjacent tanks in said group or railway tanks are all also open, and where pumping continues until all the tanks are filled up to a full level, wherein a first tank closest to a supply end (F) is filled up first due to lowest pressure drop in the filling and discharge line (A) between the supply end (F) and a first one of the valves (C), after which next tanks of the plurality of tanks are filled in sequence both via the valves (C) and via overflow pipes (D) until all the tanks are filled up and fluid enters the overflow pipe (D) in the one of the tanks situated furthest away from the supply end (F), whereafter all the valves (C) are closed.

3. An apparatus according to the method of claim 1, comprising the common, filling and discharge line (A) is continuous and is permanently mounted along the row of tanks, is connected to each individual tank with a respective one of the valves (C), and wherein each tank in the row of tanks is connected to an adjacent one of the tanks by a pipeline (D) at the top of the tank, the pipeline including means for ventilating and topping off the tank, and wherein the pipeline (D) may be shut off prior to transport with the aid of the safety-valves (E) placed on each tank.

4. The apparatus according to claim 3, wherein the permanently mounted, common, filling and discharge line (A) is placed inside the tanks for maximum protection in the case of accidents, the filling and discharge line (A) includes branch pipes to the lowest level in any of the tanks and the branch pipes are each provided with respective shut-off valves (C').

5. The apparatus according to claim 3, wherein the respective one of the valves (C) is the only valve in each tank associated with the filling and discharge line and wherein the filling and discharge line is unobstructed by any valve.

6. In a row of adjacent railway tank cars, the improvement comprising:

each car of the row of cars including a respective bottom pipe (A) and a respective return pipe (D);

the bottom pipe communicating with a lower interior point of the car through a bottom valve (C or C');

the return pipe communicating with an upper interior point of the car through a safety valve (E);

first means for coupling adjoining bottom pipes of adjacent cars of the row of cars for fluid communication therebetween; and second means for coupling adjoining return pipes of adjacent cars of the row of cars for fluid communication therebetween.

7. The improvement according to claim 6, wherein at least one of the first means for coupling and the second means for coupling includes pipe-interconnecting flexible hoses.

8. The improvement according to claim 6, wherein the bottom pipe is disposed generally under each car.

9. The improvement according to claim 6, comprising an vertical pipe, and wherein the bottom pipe is disposed in an upper portion of the car and the vertical pipe communicates between the bottom pipe and the bottom valve (C') disposed in the lower interior point of each car.

10. The improvement according to claim 6, wherein each car includes a pair of the return pipe and a corresponding respective pair of the safety valves, disposed at respective ends of the car.

* * * * *